US010927694B2

(12) United States Patent
Clark et al.

(10) Patent No.: US 10,927,694 B2
(45) Date of Patent: Feb. 23, 2021

(54) BOAS CARRIER WITH COOLING SUPPLY

(71) Applicant: United Technologies Corporation, Farmington, CT (US)

(72) Inventors: Thomas E. Clark, Sanford, ME (US); William M. Barker, North Andover, MA (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 40 days.

(21) Appl. No.: 16/352,150

(22) Filed: Mar. 13, 2019

(65) Prior Publication Data

US 2020/0291804 A1 Sep. 17, 2020

(51) Int. Cl.

*F01D 11/08* (2006.01)
*F01D 25/12* (2006.01)
*F01D 25/00* (2006.01)

(52) U.S. Cl.

CPC ..... *F01D 11/08* (2013.01); *F01D 25/12* (2013.01); *F01D 25/005* (2013.01); *F05D 2220/32* (2013.01); *F05D 2240/11* (2013.01); *F05D 2260/20* (2013.01)

(58) Field of Classification Search

CPC ..... F01D 11/08; F01D 25/12; F01D 25/005; F05D 2220/32; F05D 2240/11; F05D 2260/20; F05D 2260/202

See application file for complete search history.

(56) References Cited

U.S. PATENT DOCUMENTS 5,092,735 A * 3/1992 Katy ..... F01D 11/08 415/115
5,273,396 A * 12/1993 Albrecht ..... F01D 11/24 415/115
7,011,493 B2 * 3/2006 Marchi ..... F01D 9/04 415/116
10,100,654 B2 10/2018 Vetters et al.
10,184,352 B2 1/2019 O'Leary et al.
2004/0141838 A1 * 7/2004 Thompson ..... F01D 25/246 415/209.3

(Continued)

FOREIGN PATENT DOCUMENTS

EP 2631434 8/2013
EP 3115561 1/2017

(Continued)

OTHER PUBLICATIONS

EP Extended Search Report for EP Application No. EP19213872.5 dated Feb. 19, 2020.

(Continued)

*Primary Examiner* — Nathaniel E Wiehe
*Assistant Examiner* — Eric A Lange
(74) *Attorney, Agent, or Firm* — Carlson, Gaskey & Olds, P.C.

(57) ABSTRACT

A blade outer air seal assembly includes a support structure. A blade outer air seal has a plurality of seal segments arranged circumferentially about an axis and mounted in the support structure by a carrier. A coverplate is arranged between the carrier and at least one of the plurality of seal segments. The coverplate forms a first passage between the coverplate and the carrier and a second passage between the coverplate and the seal segment.

17 Claims, 5 Drawing Sheets

(56) References Cited

U.S. PATENT DOCUMENTS

| | | | | |
|---|---|---|---|---|
| 2005/0111965 | A1* | 5/2005 | Lowe | F01D 25/12 415/116 |
| 2005/0141989 | A1* | 6/2005 | Sayegh | F01D 25/12 415/116 |
| 2005/0232752 | A1 | 10/2005 | Meisels | |
| 2007/0025837 | A1 | 2/2007 | Pezzetti | |
| 2008/0206046 | A1* | 8/2008 | Razzell | F01D 9/04 415/173.1 |
| 2016/0146044 | A1* | 5/2016 | Bergman | F02C 3/04 60/806 |
| 2016/0258311 | A1 | 9/2016 | Varney et al. | |
| 2017/0114670 | A1* | 4/2017 | Shapiro | F01D 25/24 |
| 2018/0251921 | A1 | 9/2018 | Shi | |

FOREIGN PATENT DOCUMENTS

| | | |
|---|---|---|
| EP | 3587751 | 1/2020 |
| EP | 3620616 | 3/2020 |
| WO | 20150031764 | 3/2015 |
| WO | 20150191174 | 12/2015 |

OTHER PUBLICATIONS

Extended EP Search Report for EP Application No. 20158324.2 dated May 20, 2020.

* cited by examiner

BOAS CARRIER WITH COOLING SUPPLY

BACKGROUND

This application relates to a blade outer air seal carrier.

Gas turbine engines are known and typically include a compressor compressing air and delivering it into a combustor. The air is mixed with fuel in the combustor and ignited. Products of the combustion pass downstream over turbine rotors, driving them to rotate.

It is desirable to ensure that the bulk of the products of combustion pass over turbine blades on the turbine rotor. As such, it is known to provide blade outer air seals radially outwardly of the blades. Blade outer air seals have been proposed made of ceramic matrix composite fiber layers.

SUMMARY

In one exemplary embodiment, a blade outer air seal assembly includes a support structure. A blade outer air seal has a plurality of seal segments arranged circumferentially about an axis and mounted in the support structure by a carrier. A coverplate is arranged between the carrier and at least one of the plurality of seal segments. The coverplate forms a first passage between the coverplate and the carrier and a second passage between the coverplate and the seal segment.

In a further embodiment of the above, the coverplate is welded to the carrier.

In a further embodiment of any of the above, the first passage has a first height and the second passage has a second height. The first height is the same or larger than the second height.

In a further embodiment of any of the above, the first height is between about 0.030 and 0.100 inches (0.762-2.54 mm).

In a further embodiment of any of the above, the first passage extends in a generally circumferential direction.

In a further embodiment of any of the above, the carrier has a channel in a radially inner surface, the channel forming the first passage.

In a further embodiment of any of the above, a hole extends radially through the carrier.

In a further embodiment of any of the above, a cooling path is defined through the hole, along the first passage, along the second passage, and through a film cooling array on the seal segment.

In a further embodiment of any of the above, the hole is centered circumferentially on the carrier.

In a further embodiment of any of the above, the hole is centered axially on the carrier.

In a further embodiment of any of the above, the carrier has first and second hooks that form a dovetail shape for engagement with the support structure. An axial passage is formed between the first and second hooks.

In a further embodiment of any of the above, the axial passage is in fluid communication with a hole in the carrier.

In a further embodiment of any of the above, the seal segment has first and second walls that extend from an inner platform and joined at an outer wall to form a circumferentially extending passage.

In a further embodiment of any of the above, at least a portion of the carrier and the coverplate are arranged within the circumferentially extending passage of the seal segment.

In a further embodiment of any of the above, the blade outer air seal is a ceramic matrix composite material.

In a further embodiment of any of the above, the carrier is a metallic material.

In a further embodiment of any of the above, the coverplate is a metallic material.

In another exemplary embodiment, a turbine section for a gas turbine engine includes a turbine blade that extends radially outwardly to a radially outer tip and for rotation about an axis of rotation. A blade outer air seal has a plurality of seal segments arranged circumferentially about the axis of rotation. Each of the segments are mounted in a support structure radially outward of the outer tip via a carrier. The carrier has a plurality of carrier segments. A coverplate is arranged at a radially inward portion of each of the plurality of carrier segments. Each coverplate forms a first passage between the coverplate and the carrier and a second passage between the coverplate and a seal segment.

In a further embodiment of any of the above, a cooling path is defined through a hole in the carrier, along the first passage, along the second passage, and through a film cooling array on the seal segment.

In a further embodiment of any of the above, the blade outer air seal is a ceramic matrix composite material. The carrier is a metallic material and the coverplate is a metallic material.

These and other features may be best understood from the following drawings and specification.

DETAILED DESCRIPTION

Figure 1:
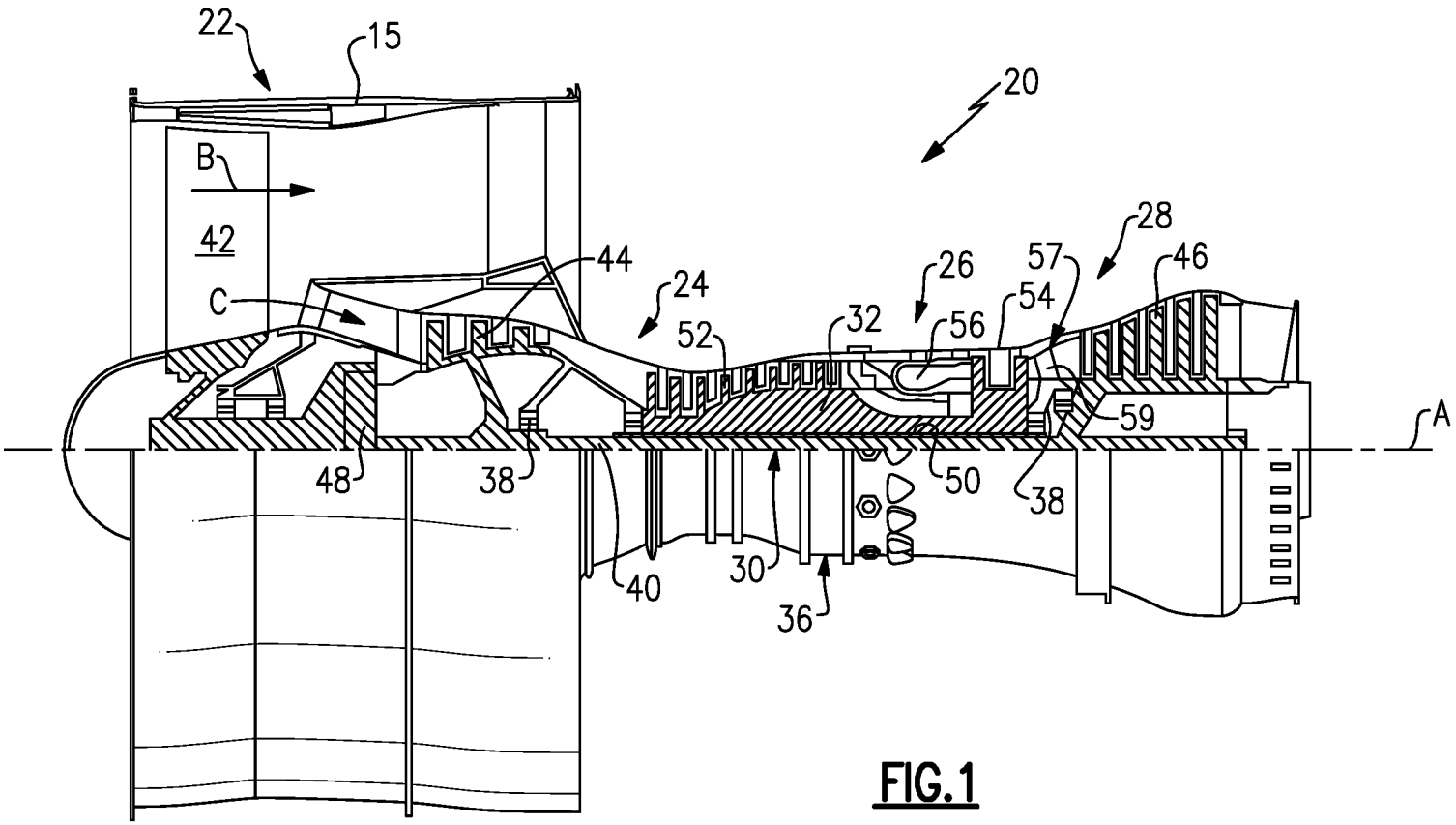
FIG. 1 schematically shows a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in the exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in the exemplary gas turbine engine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five (5:1). Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
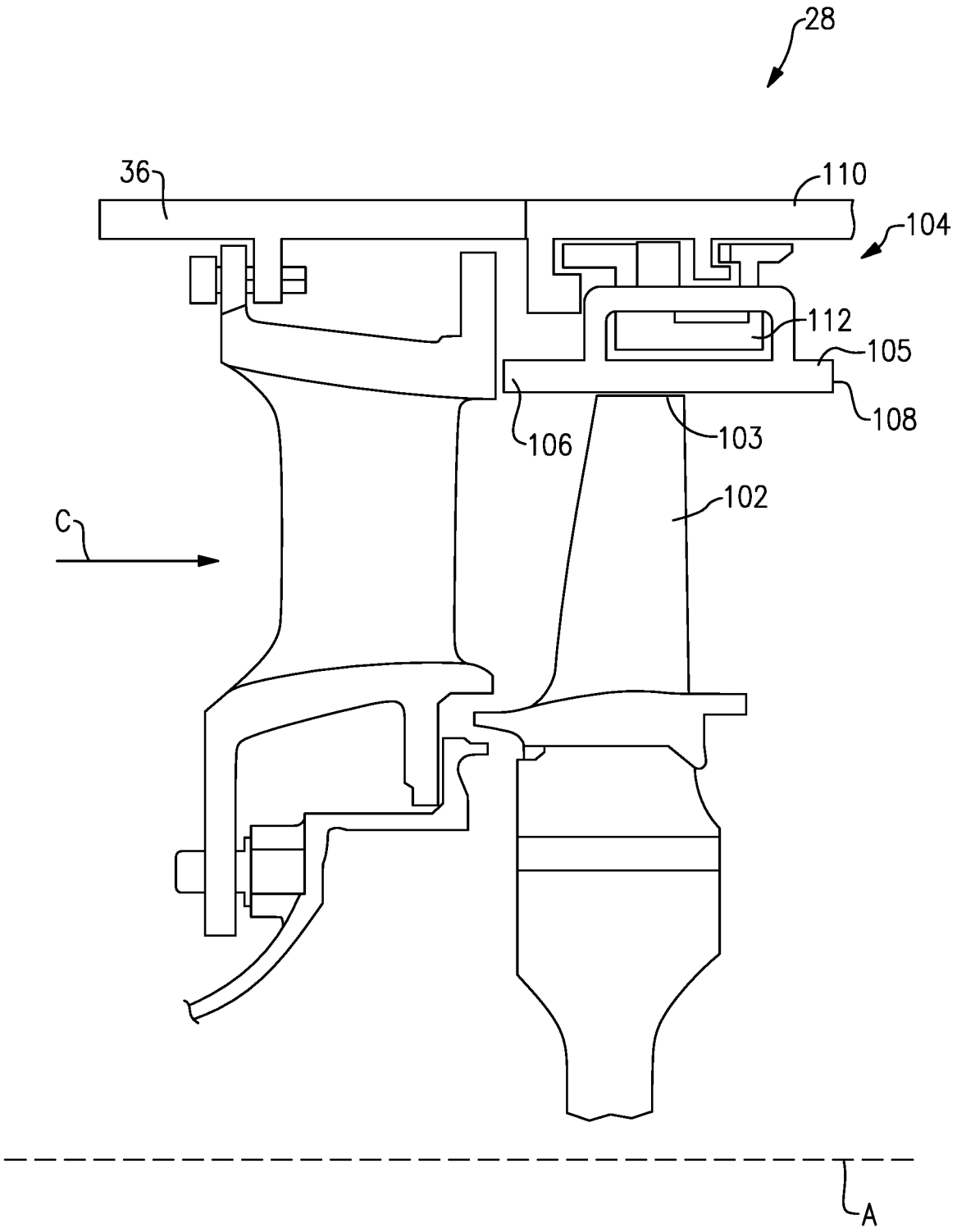
FIG. 2 shows a portion of a turbine section.

FIG. 2 shows a cross section of a portion of an example turbine section 28, which may be incorporated into a gas turbine engine such as the one shown in FIG. 1. However, it should be understood that the turbine section 28 could be utilized in other gas turbine engines, and even gas turbine engines not having a fan section at all.

A turbine blade 102 has a radially outer tip 103 that is spaced from a blade outer air seal ("BOAS") assembly 104. The BOAS assembly 104 may be made up of a plurality of seal segments 105 that are circumferentially arranged in an annulus about the central axis A of the engine 20. The seal segments 105 have a leading edge 106 and a trailing edge 108. The seal segments 105 may be monolithic bodies that are formed of a high thermal-resistance, low-toughness material, such as a ceramic matrix composite ("CMC"). In another embodiment, the seal segments 105 may be formed from another material, such as monolithic ceramic or a metallic alloy. The BOAS segments 105 are mounted to a BOAS support structure 110 via an intermediate carrier 112. The support structure 110 may be mounted to an engine structure, such as engine static structure 36. In some examples, the support structure 110 is integrated with engine static structure 36.

Figure 3:
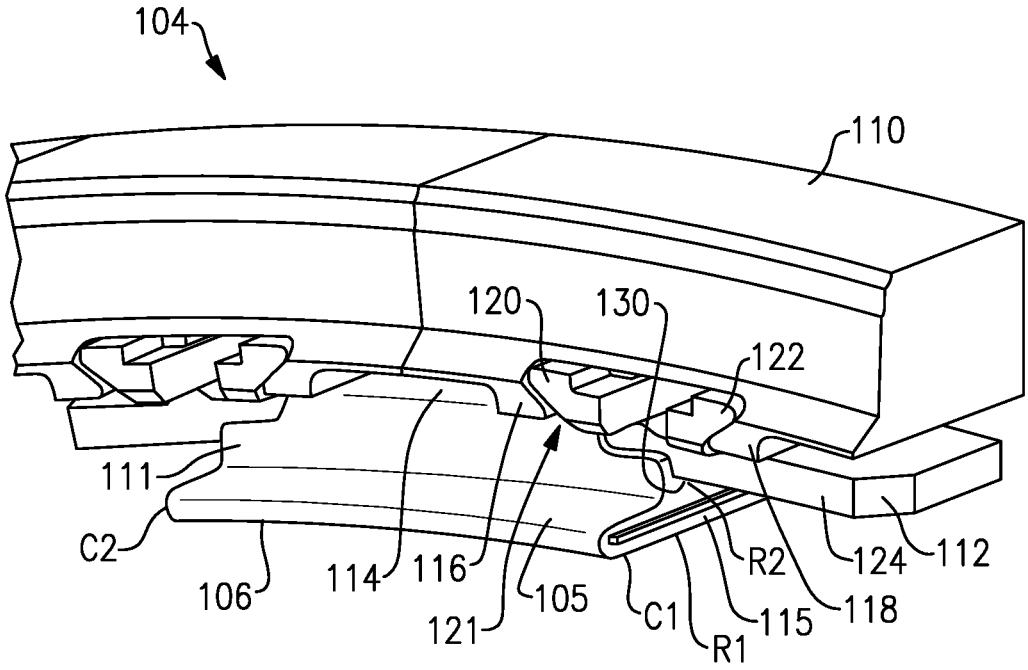
FIG. 3 shows a view of an exemplary blade outer air seal assembly.

FIG. 3 shows an exemplary BOAS assembly 104. The BOAS segment 105 is mounted to the engine 20 via the support structure 110 and intermediate carrier 112. Each seal segment 105 has a platform 115 that defines radially inner and outer sides R1, R2, respectively, and first and second circumferential sides C1, C2, respectively. The radially inner side R1 faces in a direction toward the engine central axis A. The radially inner side R1 is thus the gas path side of the seal segment 105 that bounds a portion of the core flow path C. The leading edge 106 faces in a forward direction toward the front of the engine 20 (i.e., toward the fan 42), and the trailing edge 108 faces in an aft direction toward the rear of the engine 20 (i.e., toward the exhaust end).

The support structure 110 may be a unitary structure or a plurality of segments arranged circumferentially about the engine axis A. The support structure 110 has a plurality of hooks 116, 118 extending radially inward to engage with the intermediate carrier 112.

The intermediate carrier 112 has a circumferentially extending platform 124 having several radial protrusions, such as hooks 120, 122. Hooks 120, 122 extend radially outward from the platform 124 of the carrier 112 to engage the hooks 116, 118 of the support structure 110. The hooks 120, 122 extend along the carrier 112 in the axial direction and hook in opposite circumferential directions to form a dovetail 121. That is, hook 122 curves in a direction towards the first circumferential side C1, while hook 120 curves in a direction towards the second circumferential side C2.

In the illustrated embodiment, the seal segment 105 is a loop BOAS segment. That is, the seal segment 105 generally has first and second walls 111, 113 extending radially outward from the platform 115 and joined by an outer wall 114 to form a circumferentially extending passage 130.

Edges on the outer wall 114, first wall 111, and second wall 113 provide surfaces for engagement with the carrier 112.

In this embodiment, the seal segment 105 is formed of a ceramic matrix composite ("CMC") material. The BOAS segment 105 is formed of a plurality of CMC laminate plies. The laminates may be silicon carbide fibers, formed into a woven fabric in each layer. The fibers may be coated by a boron nitride. In some embodiments it may be desirable to add additional material to make the laminates more stiff than their free woven fiber state. Thus, a process known as densification may be utilized to increase the density of the laminate material after assembly. Densification includes injecting material, such as a silicon carbide matrix material, into spaces between the fibers in the laminate plies. This may be utilized to provide 100% of the desired densification, or only some percentage. One hundred percent densification may be defined as the layers being completely saturated with the matrix and about the fibers. One hundred percent densification may be defined as the theoretical upper limit of layers being completely saturated with the matrix and about the fibers, such that no additional material may be deposited. In practice, 100% densification may be difficult to achieve. Although a CMC loop BOAS segment 105 is shown, other BOAS arrangements may be utilized within the scope of this disclosure.

Figure 4:
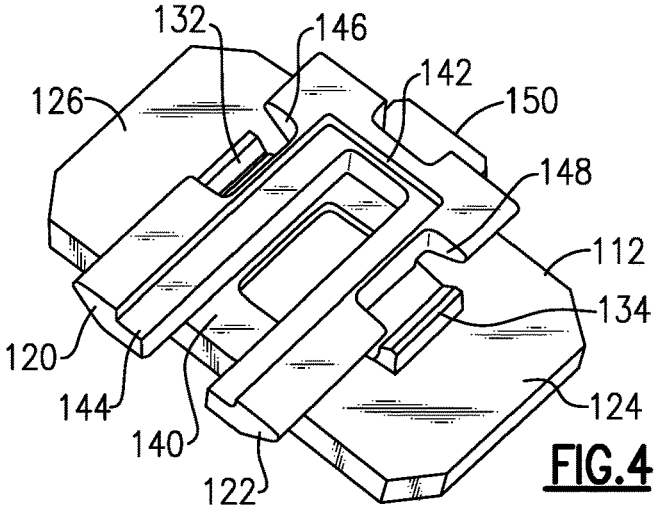
FIG. 4 shows a view of a blade outer air seal carrier.

FIG. 4 shows a view of the carrier 112. The platform 124 of the intermediate carrier 112 has a first end portion 126 and a second end portion 128. The first and second end portions 126, 128 are configured to engage with the seal segment 105. In this example, the seal segment 105 is a loop BOAS defining a circumferentially extending passage 130. The end portions 126, 128 are located within the passage 130. First and second posts 132, 134 are arranged on either side of the first and second hooks 120, 122 for engagement with the seal segment 105. For example, the posts 132, 134 abut an edge 136 of the BOAS passage 130 when the carrier 112 is assembled with the seal segment 105. The posts 132, 134 may help radially contain the carrier 112 and prevent rotation of the seal segment 105.

An axially extending passage 140 is arranged between the first and second hooks 120, 122. The passage 140 extends a portion of the axial length of the carrier 112 from the leading edge to a wall 142 near the trailing edge. The passage 140 provides weight reduction for the carrier 112. The passage 140 may also engage with anti-rotation features on the support structure 110. The passage 140 may have a shoulder 144 for accommodating anti-rotation features of the support structure 110.

The first and second hooks 120, 122 may have first and second notches 146, 148, respectively. The first and second notches 146, 148 extend radially through the first and second hooks 120, 122. The first and second notches 146, 148 may permit cooling flow to flow radially inward to the seal segment 105. The first and second notches 146, 148 may also provide tooling access to the platform 124 to form posts 132, 134. In one example, the posts 132, 134 are milled into the carrier 112, and the notches 146, 148 permit tooling to form the posts 132, 134. A tab 150 may extend axially outward from the carrier 112. The tab 150 may be near the trailing edge. The tab 150 engages with an edge of the seal segment 105, and provides an axial load-bearing surface. The first and second hooks 120, 122 may engage with an edge of the seal segment 105 to provide an axial load-bearing surface near the leading edge 106.

Figure 5:
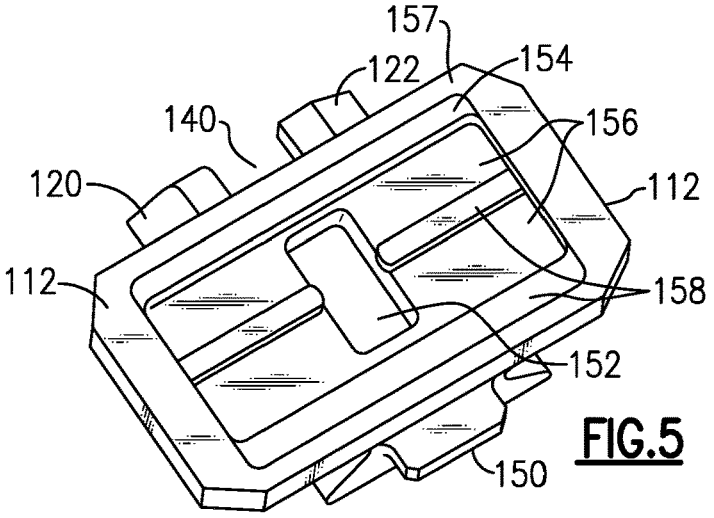
FIG. 5 shows a view of a blade outer air seal carrier.

FIG. 5 shows another view of the carrier 112. This view shows a radially inner side of the carrier 112. A hole 152 extends radially through the carrier 112 between the first and second hooks 120, 122. The hole 152 is in fluid communication with the passage 140. The hole 152 may be centered on the carrier 112 in the axial and/or circumferential directions. A recess 154 is machined into the radially inner surface of the carrier 112. In the illustrated embodiment, the recess 154 is generally rectangular in shape and extends most of the width and length of the carrier in the circumferential and axial directions. A perimeter portion 157 forms the radially innermost surface of the carrier 112. Channels 156 are machined into the recess 154. The recess 154 has a first depth relative to the perimeter portion 157 and the channels 156 have a second depth relative to the perimeter portion 157. The second depth is greater than the first depth. In other words, the channels 156 are bounded along circumferential edges by raised portions 158.

Figure 6:
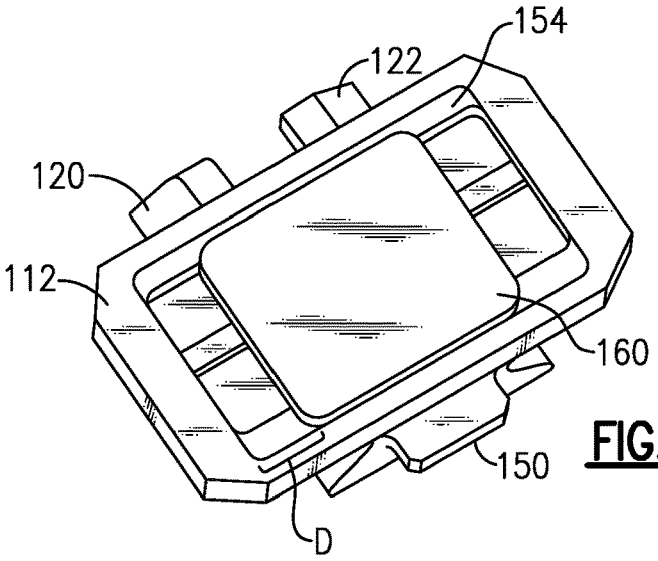
FIG. 6 shows a view of a blade outer air seal carrier.

FIG. 6 shows a view of the carrier 112 with a coverplate 160. The coverplate 160 may be welded to the raised portions 158 of the carrier 112, for example. In other embodiments, the coverplate 160 may be secured to the carrier 112 via an adhesive or friction fit, as examples. The coverplate 160 covers the hole 152, but is smaller than the recess 154. The coverplate 160 may be formed from sheet metal. In one example, the coverplate is about 0.022 inches (0.559 mm) thick. However, other thicknesses may be used. Since the coverplate 160 is smaller than the recess 154, a distance D of the recess 154 remains uncovered. In one example, the distance D is at least 0.10 inches (2.54 mm).

Figure 7:
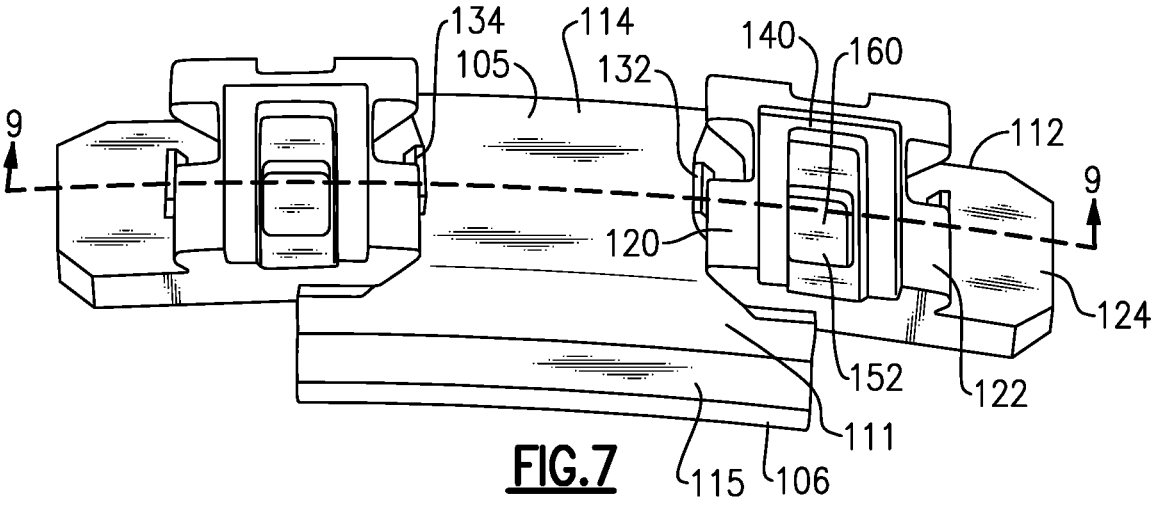
FIG. 7 shows a view of the exemplary blade outer air seal assembly.

FIG. 7 shows a portion of the assembly 104. When the carrier 112 is engaged with a seal segment 105, a portion of the coverplate 160 is arranged within the passage 130 along with the first portion 126. The post 132 is in engagement with an edge of the outer wall 114 of the seal segment 105.

Figure 8:
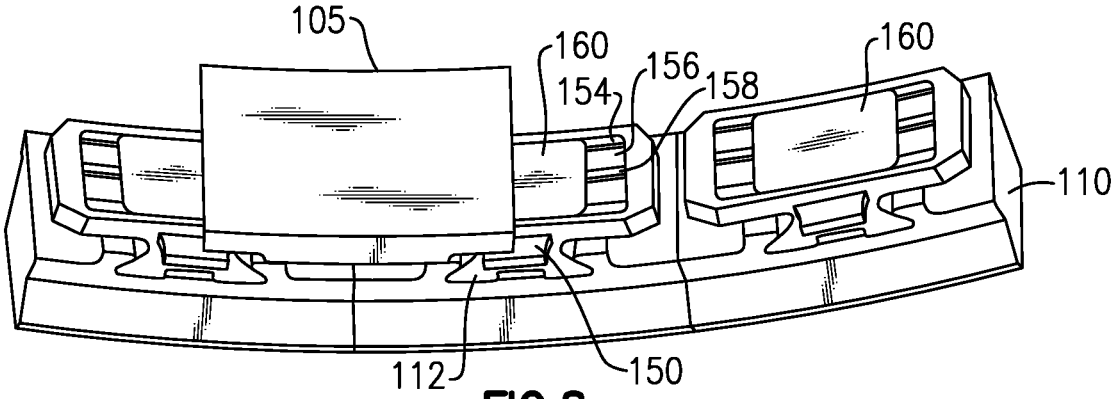
FIG. 8 shows a view of the exemplary blade outer air seal assembly.

FIG. 8 shows another view of a portion of the assembly 104. About half of the coverplate 160 is adjacent the second radial side R2 of the seal segment 105 within the passage 130. When a plurality of BOAS segments 105 are arranged about the engine axis A, half of the coverplate 160 is in a first seal segment 105, and the other half of the coverplate 160 will be in an adjacent seal segment 105.

Figure 9:
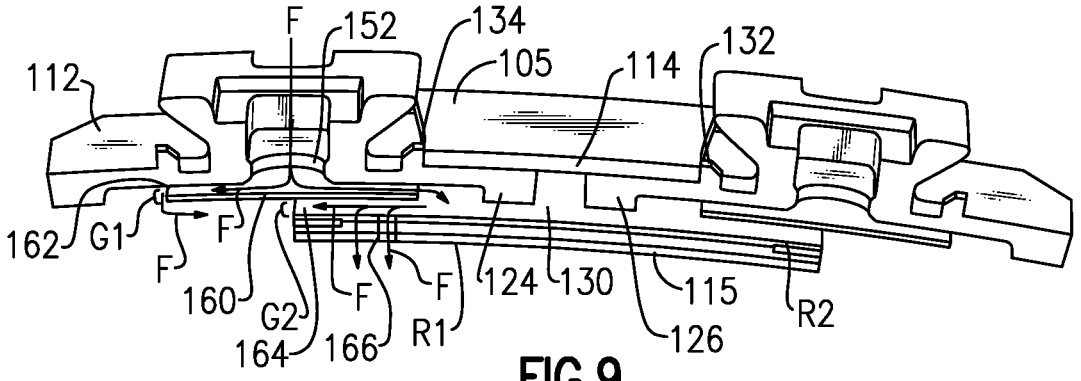
FIG. 9 shows a cross-section of the exemplary blade outer air seal assembly of FIG. 7.

FIG. 9 shows a cross-sectional view of the assembly 104 along line 9-9 (shown in FIG. 7). The channels 156 in the carrier 112 form a first passage 162 having a height G1 between the carrier 112 and the coverplate 160. The coverplate 160 and the second radial side R2 of the seal segment 105 form a second passage 164 having a second height G2. Cooling air F flows radially inward through the hole 152, and the coverplate 160 directs the cooling air F away from matefaces and towards the center of the seal segment 105. In one example, the first gap G1 is about 0.030 to 0.100 inches (0.762-2.54 mm). In a further embodiment, the first gap G1 is about 0.060 inches (1.524 mm). The second gap G2 may be the same size as the first gap G1. In some examples, the second gap G2 may be smaller than the first gap G1. The seal segment 105 may have a film cooling array 166 on the platform 115. The film cooling array 166 may include a plurality of cooling holes that extend through the platform 115. The cooling air F may flow through the film cooling array after it has been diverted by the coverplate 160 to provide a film of cooling air along the radially inner surface of the platform 115.

The disclosed carrier having a hole and coverplate direct cooling air more efficiently than known designs. Some known designs dump cooling air locally, which can cause high stress in ceramic parts. The coverplate diverts cooling air circumferentially before dumping onto a mateface. The channels 156 direct cooling air circumferentially to improve the distribution of cooling air over the BOAS segment 105.

In this disclosure, "generally axially" means a direction having a vector component in the axial direction that is greater than a vector component in the circumferential direction, "generally radially" means a direction having a vector component in the radial direction that is greater than a vector component in the axial direction and "generally circumferentially" means a direction having a vector component in the circumferential direction that is greater than a vector component in the axial direction.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A blade outer air seal assembly, comprising:

a support structure;

a blade outer air seal having a plurality of seal segments arranged circumferentially about an axis and mounted in the support structure by a carrier, wherein the seal segment has first and second walls extending from an inner platform and joined at an outer wall to form a circumferentially extending passage; and a coverplate arranged between the carrier and at least one of the plurality of seal segments, wherein at least a portion of the carrier and the coverplate are arranged within the circumferentially extending passage of the seal segment, the coverplate forming a first passage between the coverplate and the carrier and a second passage between the coverplate and the seal segment, wherein the carrier has a channel in a radially inner surface, the channel forming the first passage, wherein the channel is formed in a recess, the recess extends a distance in a circumferential direction and the coverplate has a width in the circumferential direction that is smaller than the distance.

2. The blade outer air seal assembly of claim 1, wherein the coverplate is welded to the carrier.

3. The blade outer air seal assembly of claim 1, wherein the first passage has a first height and the second passage has a second height, and wherein the first height is the same or larger than the second height.

4. The blade outer air seal assembly of claim 3, wherein the first height is between about 0.030 and 0.100 inches (0.762-2.54 mm).

5. The blade outer air seal assembly of claim 1, wherein the first passage extends generally in the circumferential direction.

6. The blade outer air seal assembly of claim 1, wherein a hole extends radially through the carrier.

7. The blade outer air seal assembly of claim 6, wherein a cooling path is defined through the hole, along the first passage, along the second passage, and through a film cooling array on the seal segment.

8. The blade outer air seal assembly of claim 6, wherein the hole is centered circumferentially on the carrier.

9. The blade outer air seal assembly of claim 6, wherein the hole is centered axially on the carrier.

10. The blade outer air seal assembly of claim 1, wherein the carrier has first and second hooks that form a dovetail shape for engagement with the support structure, and an axial passage is formed between the first and second hooks.

11. The blade outer air seal assembly of claim 10, wherein the axial passage is in fluid communication with a hole in the carrier.

12. The blade outer air seal assembly of claim 1, wherein the blade outer air seal is a ceramic matrix composite material.

13. The blade outer air seal assembly of claim 12, wherein the carrier is a metallic material and the coverplate is a metallic material.

14. The blade outer air seal assembly of claim 1, wherein the carrier is a metallic material.

15. The blade outer air seal assembly of claim 1, wherein the coverplate is a metallic material.

16. A turbine section for a gas turbine engine, comprising:

a turbine blade extending radially outwardly to a radially outer tip and for rotation about an axis of rotation;

a blade outer air seal having a plurality of seal segments arranged circumferentially about the axis of rotation, each of the segments mounted in a support structure radially outward of the outer tip via a carrier, wherein the plurality of seal segments comprises a first seal segment and a second seal segment adjacent the first seal segment, wherein each of the plurality of seal segments has a first wall and a second wall extending from an inner platform and joined at an outer wall to form a circumferentially extending passage;

wherein the carrier has a plurality of carrier segments, and a coverplate arranged at a radially inward portion of each of the plurality of carrier segments, at least a portion of the carrier and the coverplate are arranged within the circumferentially extending passage, and one of the coverplates is arranged partially within the circumferentially extending passage of the first seal segment and partially within the circumferentially extending passage of the second seal segment, each coverplate forming a first passage between the coverplate and the carrier and a second passage between the coverplate and a seal segment, wherein a cooling path is defined through a hole in the carrier, circumferentially along the first passage, along the second passage, and through a film cooling array on the seal segment.

17. The turbine section of claim 16, wherein the blade outer air seal is a ceramic matrix composite material, the carrier is a metallic material, and the coverplate is a metallic material.

* * * * *